United States Patent [19]

Schlueter

[11] 4,077,365

[45] Mar. 7, 1978

[54] EXPANSIBLE CHAMBER APPARATUS

[76] Inventor: James B. Schlueter, Box 1, Breese, Ill. 62230

[21] Appl. No.: 714,008

[22] Filed: Aug. 13, 1976

Related U.S. Application Data

[62] Division of Ser. No. 602,220, Aug. 6, 1975, abandoned.

[51] Int. Cl.[2] ..... F02B 57/06

[52] U.S. Cl. ..... 123/43 R; 123/44 C; 123/44 D

[58] Field of Search ..... 123/43 R, 43 AA, 43 A, 123/43 C, 44 R, 44 D, 44 E

[56] References Cited

U.S. PATENT DOCUMENTS

| | | | |
|---|---|---|---|
| 984,358 | 2/1911 | Dawson | 123/43 R |
| 1,040,716 | 10/1912 | Manrodt | 123/43 C |
| 1,462,182 | 7/1923 | Weigel | 123/44 C |
| 2,126,093 | 8/1938 | Curtis | 123/43 C |
| 2,273,025 | 2/1942 | Dillstrom | 123/44 D |
| 2,990,820 | 7/1961 | Saijo | 123/43 R |
| 3,499,424 | 3/1970 | Rich | 123/44 D |
| 3,844,256 | 10/1974 | Ishikawa | 123/8.45 |

FOREIGN PATENT DOCUMENTS

| | | | |
|---|---|---|---|
| 85,423 | 9/1921 | Austria | 123/43 R |
| 410,946 | 3/1925 | Germany | 123/44 D |
| 376,317 | 5/1964 | Switzerland | 123/43 R |
| 28,250 of | 1/1910 | United Kingdom | 123/44 D |

*Primary Examiner*—Clarence R. Gordon

*Attorney, Agent, or Firm*—Koenig, Senniger, Powers and Leavitt

[57] ABSTRACT

Expansible chamber apparatus for use either as an internal combustion engine or as a pump comprising a stationary housing, a cylinder block rotatable within the housing about a central axis, a shaft secured to and rotatable with a cylinder block with the longitudinal center line of the shaft constituting the above-mentioned axis. A stationary gear is carried by the housing and surrounds the shaft. The cylinder block has a plurality of cylinders therein with the longitudinal axes of these cylinders being tangent to a circle surrounding the axis. A piston for each cylinder is reciprocable within its respective cylinder and a connecting rod and an eccentric gear are provided so as to connect each piston to the stationary gear for effecting rotation of the cylinder block and the shaft relative to the housing and for effecting reciprocation of the pistons. Inlets and outlets are provided in the housing for the inlet and outlet of fluid to the cylinders as the cylinder block rotates and as the pistons reciprocate.

5 Claims, 8 Drawing Figures

EXPANSIBLE CHAMBER APPARATUS

This is a division, of application Ser. No. 602,220, filed Aug. 6, 1975 now abandoned.

BACKGROUND OF THE INVENTION

This invention relates to expansible chamber apparatus and more particularly to such apparatus which can be used either as a rotary internal-combustion engine or as a rotary pump. More specifically, this invention relates to expansible chamber apparatus in which its cylinder block rotates relative to a stationary housing.

References may be made to such U.S. Pat. Nos. 3,438,358 and 3,841,279 which show rotary internal-combustion engines in the same general field as this apparatus.

SUMMARY OF THE INVENTION

Among the several objects of this invention may be noted the provision of an expansible chamber apparatus which has a relatively high power to weight ratio; the provision of such expansible apparatus which when operated as an engine provides relatively high power and torque at comparatively low rotational speed; the provision of such an engine which is of compact size for its power output; the provision of such an engine in which diametrically opposed pistons undergo simultaneous power strokes for smooth application of power; the provision of such an engine which has fewer moving parts and fewer parts which require periodic maintenance (e.g., spark plugs, fuel injectors, etc); the provision of such an engine which may readily be manufactured utilizing conventional manufacturing techniques; and the provision of such apparatus having relatively few parts with many of these parts being interchangeable. Other objects and features of this invention will be in part apparent and in part pointed out hereinafter.

Briefly, an expansible chamber appartus of this invention for use as an internal-combustion engine or as a pump comprises a stationary housing, a cylinder block rotatable within the stationary housing about a central axis, a shaft secured to and rotatable with the cylinder block, the longitudinal center line of the shaft constituting the above-mentioned axis, and a stationary gear carried by the housing and surrounding the shaft. The cylinder block has a plurality of cylinders therein with the longitudinal axes of these cylinders being tangent to a circle surrounding the axis. A piston for each cylinder reciprocates within its respective cylinder. Means are provided for connecting each piston to said stationary gear for effecting rotation of the cylinder block and the shaft relative to the housing and for effecting reciprocation of the pistons. Means is provided in the housing for inlet and outlet of fluid to the cylinders as the cylinder block rotates and as the pistons reciprocate, the connecting means comprising a connecting link pivotally secured to each piston and a pinion gear in mesh with the stationary gear, the link being pivotally connected to the pinion gear offset from the center thereof.

BRIEF DESCRIPTION OF THE DRAWINGS

Corresponding reference characters indicate corresponding parts throughout several views of the drawings.

DESCRIPTION OF PREFERRED EMBODIMENT

Figure 1:
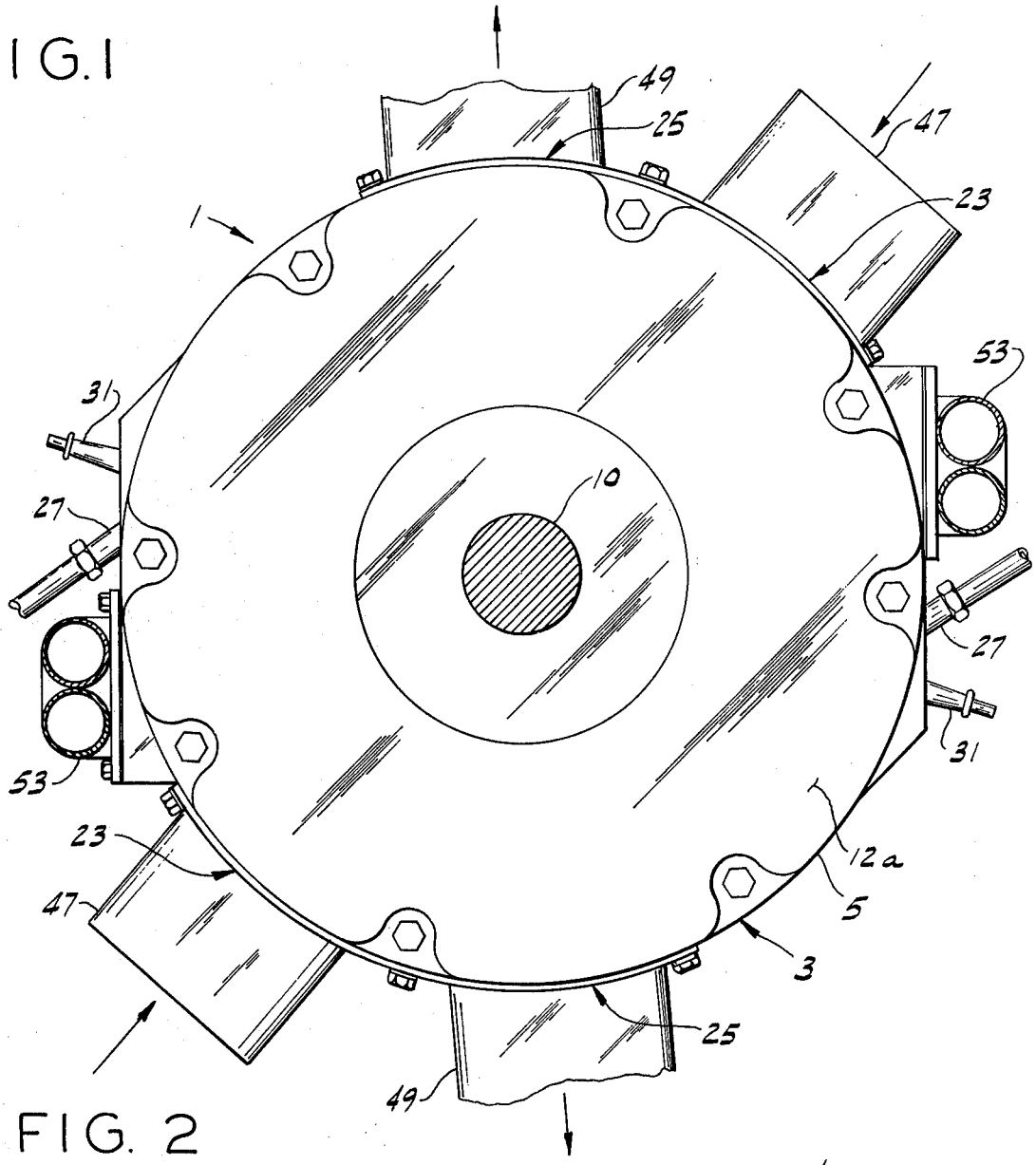
FIG. 1 is a side elevational view of an expansible chamber apparatus of this invention illustrated as a four-cycle internal-combustion engine.
Figure 2:
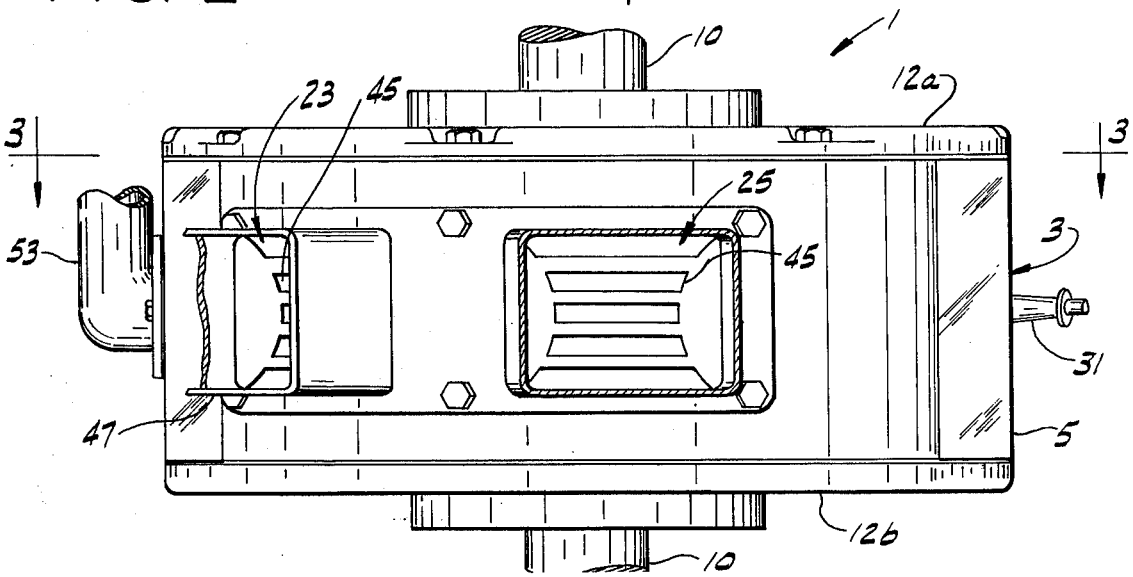
FIG. 2 is a bottom view of the engine shown in FIG. 1.

Referring now to the drawings, an expansible chamber apparatus of this invention is shown indicated in its entirety at 1. It is to be understood that this expansible chamber apparatus may be used either as an internal-combustion engine or, with suitable minor modifications which would be readily apparent to a skilled mechanic, may be used as a fluid pump. In this description, however, the apparatus will be referred to as an internal-combustion engine.

More particularly, engine 1 is shown to include a stationary cylindric housing 3 adapted to be securely mounted to a frame or base (not shown). This housing has a cylindric inner wall 5 defining a cylindric chamber 7 (see FIG. 3). A cylindric block 9 is rotatable about a central axis X—X within chamber 7. A shaft 10 is keyed to the cylinder block by means of keys 11 for rotation with the cylinder block about axis X—X. The stationary housing includes a pair of cover plates **12*a*, 12*b* adapted to be secured (e.g. bolted) to the ends of the housing so as to enclose cylinder block 9 within chamber 7. These cover plates each carry bearings B for journaling shaft 10 relative to the cover plates. Cover plates 12*a*, 12*b* also carry stationary sun gears 13*a*, 13*b*, respectively, on their inside surfaces surrounding shaft 10. These sun gears are fixedly secured to the cover plates. The cylinder block has a plurality (e.g., four) of cylinders 15 with the longitudinal axis of each of the cylinders being tangent to a circle surrounding axis X—X and having this axis X—X as its center. The axis of each cylinder 15 is preferably substantially tangent to the pitch circle of sun gears 13*a*, 13*b*. Each cylinder 15 has a respective piston 17 reciprocable therewithin through a cycle generally toward and away from sun gears 13*a*, 13*b*** along its respective cylinder axis.

Figure 3:
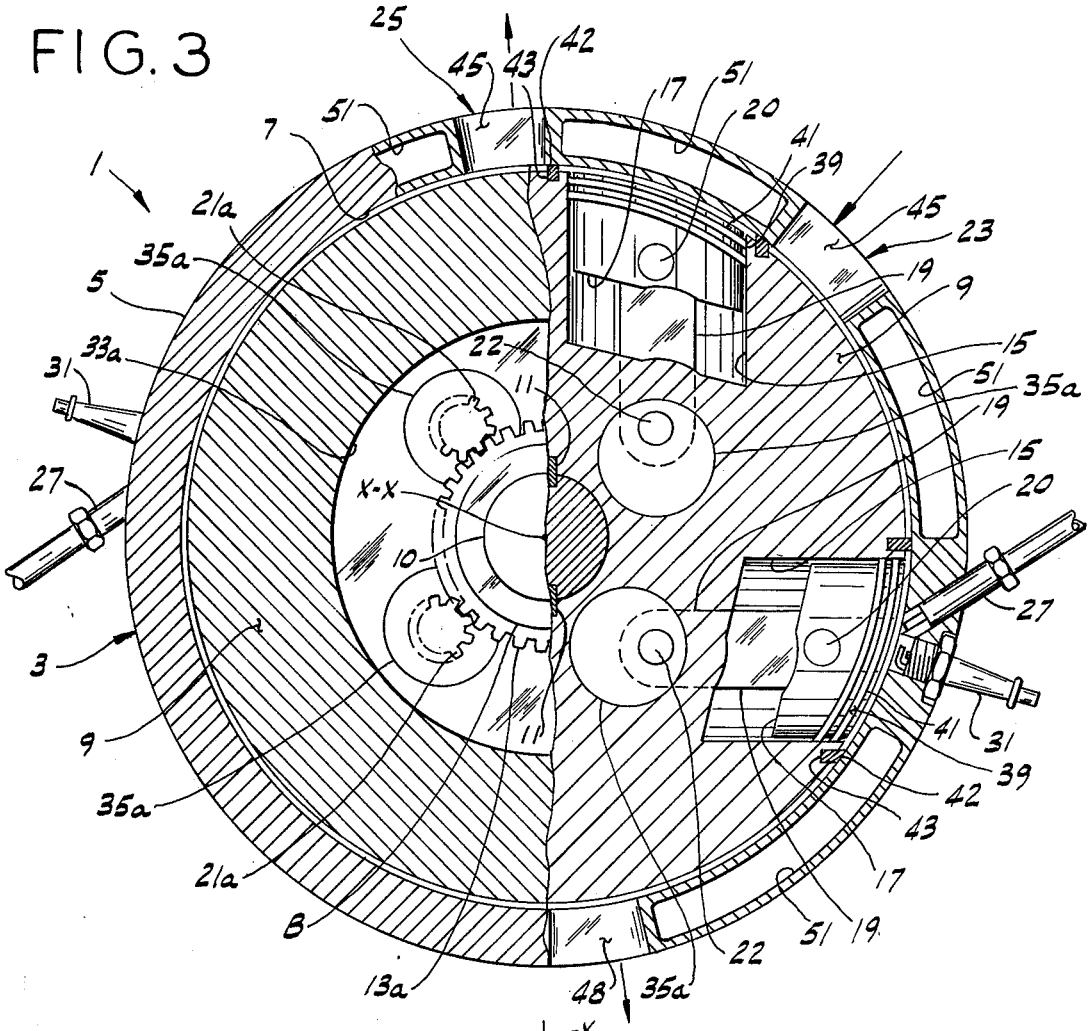
FIG. 3 is a horizontal sectional view taken on line 3—3 of FIG. 2 with parts broken away for clarity.

Each piston is interconnected to sun gears **13*a*, 13*b* by means of a connecting rod 19 pivotally connected to the piston by a wrist pin 20 and pinion gears 21*a*, 21*b* eccentrically connected to the connecting rod by a crank pin 22, the pinion gears being in mesh with respective sun gears 13*a*, 13*b* for effecting rotation of cylinder block 9 and shaft 10 relative to stationary housing 3 and cover plates 12*a*, 12*b* and for effecting reciprocation of pistons 17 in their respective cylinders 15. Inlet ports 23 and outlet ports 25 are provided in housing 3 for the inlet and outlet of fluid into the cylinders 15 as piston 17 reciprocates therewithin. As shown in FIG. 3, inlet ports 23 constitute air inlet means for the engine and outlet port means 25 constitute exhaust means for the engine. Preferably, fuel is injected into cylinder 15 at the proper time by fuel injection nozzles 27 spaced at proper intervals around housing 3. It will be understood, however, that fuel could be supplied by means of carburetors and could enter the cylinders via intake ports 23 along with the air. Spark plugs 31 or other fuel ignition means are provided at selected locations around housing 3 so as to ignite the air-fuel mixture in each cylinder at a selected position of the piston within its cylinder and to cause the piston to move through a power stroke as will be hereinafter explained. The fuel injection system and the ignition system, including spark plugs 31**, are conventional and thus are not herein described in detail.

As shown in FIG. 3, sun gears 13*a*, 13*b* have a pitch diameter four times greater than the pitch diameter of pinion gears 21*a*, 21*b* so that each piston 17 reciprocates within its cylinder 15 through four cycles (i.e., from its top dead center (TDC) position to its bottom dead center (BDC) position and then back to its TDC position four times for each revolution of the cylinder block around axis X—X). More particularly, for each one-half revolution of cylinder block 9, each piston is movable from its TDC position to its BDC position through a power stroke, thence from its BDC position to its TDC position through an exhaust stroke, thence from its TDC position to its BDC position through an intake stroke, and finally from its BDC position to its TDC position through a compression stroke. Operating in this manner, the engine is similar to a conventional four cylce reciprocating piston, internal-combustion engine. It will be noted that the rotational speed of pinion gears 21*a*, 21*b* corresponds to the rotational speed of the crankshaft of a conventional four cycle engine and that due to the speed reduction of sun gears 13*a*, 13*b* and pinions 21*a*, 21*b*, shaft 10 rotates at only one-fourth the speed of the pinion gears.

While four cylinders 15 are shown in cylinder block 9, it will be understood that an even-number plurality (e.g., 2, 4, 6, 8 . . . ) of cylinders may be utilized. Preferably, each cylinder has a corresponding cylinder diametrically opposed thereto and the pistons 17 of each of these diametrically opposed cylinders are in phase with one another so as to undergo simultaneous power strokes and to thus apply a uniform and balanced force to both sides of the cylinder block. This provides for a smooth application of power to the cylinder block on opposite sides of the axis X—X.

As previously mentioned, stationary sun gears 13*a*, 13*b* are secured to the inner faces of their respective covers 12*a*, 12*b*. These covers have a respective circular groove 33*a*, 33*b* formed in their inner faces adjacent to outer faces of the sun gears with the width of these grooves being somewhat wider than the diameter of the pinion gears, the pinion gears being received within these grooves. Pinion gears 21*a*, 21*b* for each piston are journaled by bearings 35*a*, 35*b* secured to and rotatable with cylinder block 9 for rotation of the pinion gears about their centers when in mesh with their respective sun gears 13*a*, 13*b*. The pinion gears 21*a*, 21*b* are interconnected by crank pin 22 which is offset or eccentric relative to the center of bearings 35*a*, 35*b* and gears 21*a*, 21*b*. It will be noted that the stroke of pistons 17 in their respective cylinders is twice the eccentricity of the crank pins.

Figure 4:
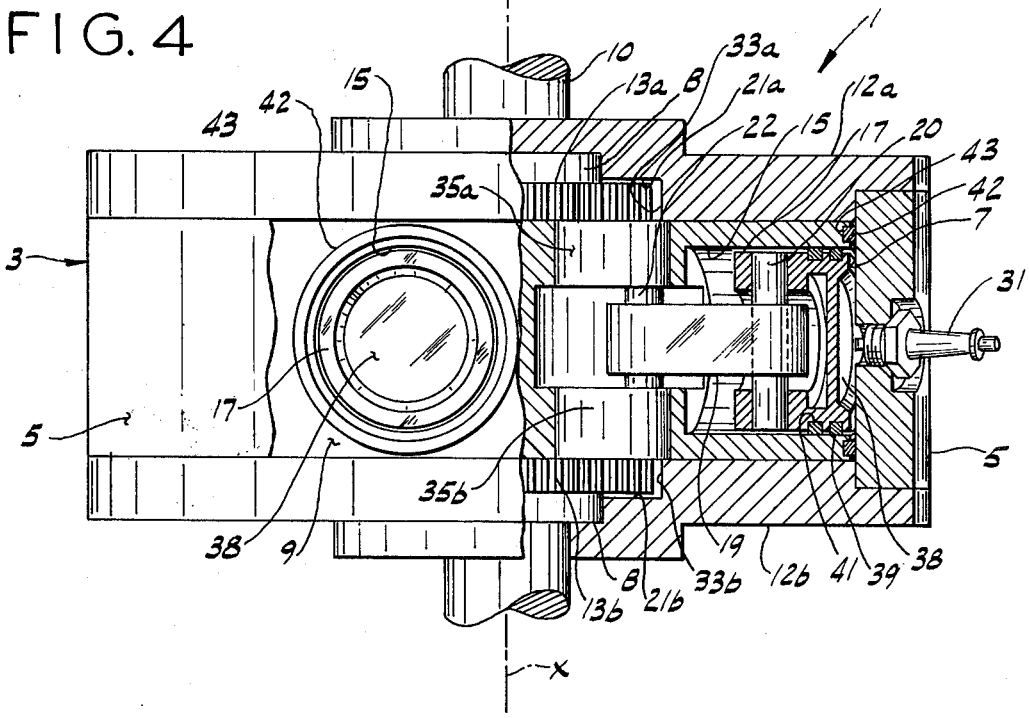
FIG. 4 is a view similar to FIG. 2 with parts removed and broken away for purposes of illustration.

Each piston 17 has a recess 38 (see FIG. 4) in its upper face for forming a combustion chamber and carries a series of sealing rings 39 in grooves 41 therein, the piston rings being in sliding, sealing engagement with the walls of cylinders 15. Also, a generally circular sealing ring 42 is received in circular groove 43 in the outer periphery of cylinder block 9 surrounding each cylinder and slidingly and sealingly engaging the cylindric inner wall surface 7 of housing 5 to seal each of the cylinders with respect to the housing as the cylinder block rotates.

Figure 5:
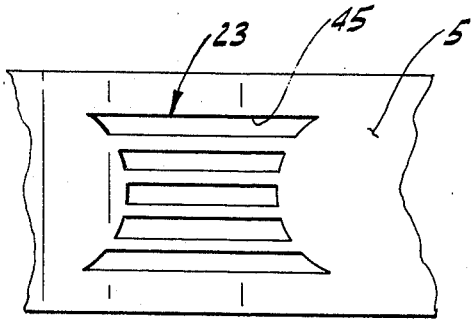
FIG. 5 is an enlarged view of a portion of the outer housing of the engine of this invention illustrating an inlet port opening for the engine with the inlet stock removed.

Referring now to FIG. 5, the configuration of inlet ports 23 and exhaust ports 25 is shown in detail. More particularly, these ports are each constituted by a series of spaced, circumferential slots 45 in cylindrical wall 5, these slots being of varying length with the longest slots being on the outside of the housing and with the ends of these slots defining a generally circular pattern. It will be noted that, as a cylinder 15 in cylinder block 9 rotates past these slots, the ends of all the slots constituting one of the ports are simultaneously opened for communication with the cylinder as the cylinder moves in registration with the slots and are simultaneously closed off from the cylinder as the latter moves past the port. In FIG. 3, it will be noted the distance between the exhaust and intake ports is somewhat less than the diameter of a cylinder 15 so as to provide overlap between the opening and closing of the intake and exhaust ports. As shown in the drawings, a ram inlet stack 47 may be provided in inlet ports 23 and exhaust pipe 49 may be secured to housing 5 in communication with the exhaust ports 25. Various components of the engine may, of course, be cooled by circulating cooling water through passages 51 therein. This cooling water may be circulated through passages 51 by cooling water manifolds 53. It will be understood that pistons 17, crank pins 22, bearings 35*a*, 35*b*, gears 13*a*, 13*b* and 21*a*, 21*b* and other movable parts may be lubricated by an appropriate lubrication system in a manner well-known in the art.

In operation, with cylinder block 9 and shaft 10 rotating in bearings B relative to stationary housing 3 and cover plates 12*a*, 12*b*, each piston 17 undergoes one operational cycle for each one-half revolution of the cylinder block. More particularly, each piston undergoes an intake stroke as it moves from its TDC position to its BDC position past intake port 23 and a compression stroke as it moves from its BDC to its TDC position thereby to compress the air therewithin. The piston further undergoes a power stroke as it moves from its TDC to its BDC position during which a pre-measured quantity of fuel injected into the cylinder by injector nozzle 27 is ignited by spark plug 31, and it undergoes an exhaust stroke as it moves from its BDC to its TDC position as the piston moves into communication with another exhaust port 25. The engine, operating on the above-described cycle, operates on the Otto cycle and its operation may be thought of as similar to a conventional four-cycle, internal-combustion reciprocating piston engine. It will be noted that due to the 4:1 gear ratio between sun gears 13*a*, 13*b* and pinion gears 21*a*, 21*b*, the pinion gears rotate four times for each revolution of cylinder block 9 and thus cause each piston to undergo two power strokes on each revolution of the cylinder block. With the axis of each cylinder 15 substantially tangent to the pitch circle of sun gears 13*a*, 13*b*, each of the pistons is connected to shaft 10 by a relatively long moment arm (e.g. approximately the radius of the pitch of the sun gears) and thus develops a relatively high torque as cylinder block 9 rotates and as the pistons reciprocate. It will be noted that on the power stroke of each piston, this moment arm is relatively long even with the piston at its TDC position. Thus, it is seen that the engine of this invention particularly advantageous for use in high torque applications.

Figure 6:
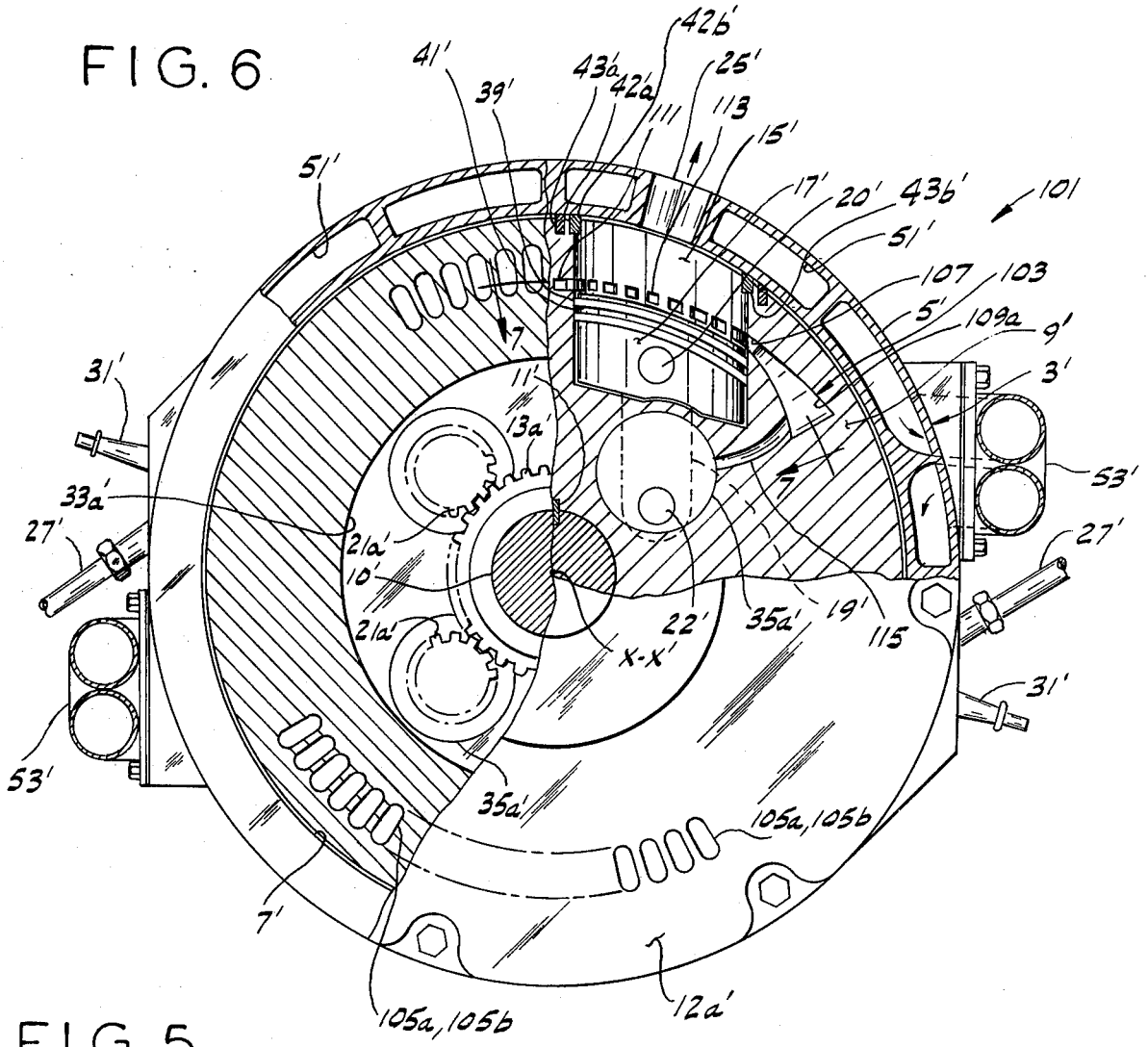
FIG. 6 is a view similar to FIG. 3 illustrating another embodiment of the engine of this invention to be operated as a two-cycle engine.
Figure 8:
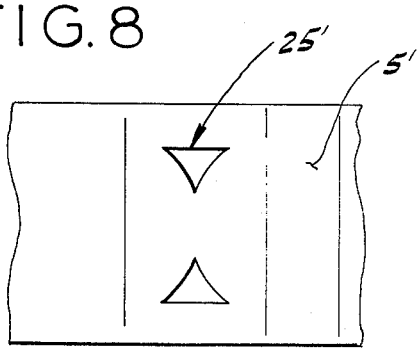
FIG. 8 is a view similar to FIG. 5 illustrating an exhaust port for the engine shown in FIG. 6.
Figure 7:
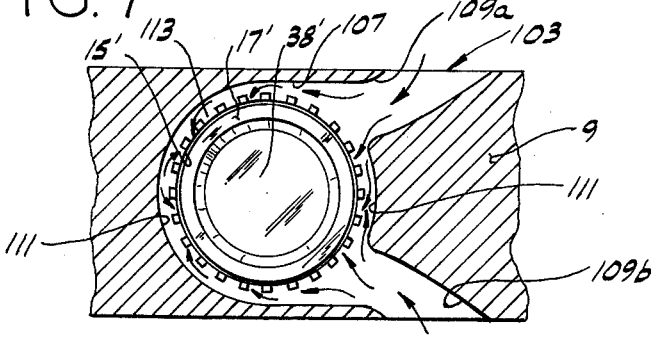
FIG. 7 is a view taken on line 7—7 of FIG. 6 illustrating the air intake means for the engine illustrated in FIG. 6.

In another embodiment of this invention, a two-cycle engine is shown in FIGS. 6–8, and is indicated in its entirety at 101 to distinguish it from engine 1 heretofore described. In FIGS. 6–8, components having the same function as components heretofore described in relation to engine 1 will be indicated as "primed". More particularly, the pitch diameter of sun gears 13*a*′, 13*b*′ is twice that of pinion gears 21*a*′, 21*b*′ so that each piston 17′ will reciprocate through one operational cycle on each one-half revolution of cylinder block 9. More particularly, each piston will move from its TDC position to its BDC position and then back to its TDC position as it undergoes a power phase, an exhaust phase, an intake phase and a compression phase during each one-half revolution of cylinder block 9. Like the four-cycle engine above-described, the two-cycle engine 101 has an even-number plurality of cylinders 15′ with a respective piston 17′ reciprocable therein and each cylinder has another cylinder diametrically opposed therefrom with the pistons of these diametrically opposed cylinders in phase with one another. The ratio of the diameter of the pitch circles of sun gears 13*a*′, 13*b*′ and the diameter of the pitch circles of pinion gears 21*a*′, 21*b*′ is 2:1 so that each pinion gear rotates through two revolutions for each revolution of cylinder block 9′.

Exhaust ports 25′ are generally similar to exhaust ports 25 of engine 1, except the openings are not as long. The intake ports of this two-cycle embodiment are, however, shown to differ from inlet ports 23 of the four-cycle engine. More particularly, the inlet ports for the two-cycle engine are indicated generally at 103 and are shown to comprise a series of radial slots 105*a*, 105*b* in respective cover plates 12*a*′, 12*b*′, and a manifold 107 surrounding each cylinder 15′ in cylinder block 9′. Each manifold 107 includes a pair of inlet passages 109*a*, 109*b* on opposite sides of cylinder block 9′ for communication with respective sets of slots 105*a*, 105*b* and cover plates 12*a*′and 12*b*′. Each of these passages leads to manifold chamber 111 surrounding each cylinder 15′, this manifold chamber having a plurality of inlet openings 113 into its respective cylinder. These inlet openings are positioned in the cylinders so as to be uncovered by piston 17′ as the piston moves to its bottom dead center position. The piston thus acts as a valve to alternately open and block communication between intake manifold 111 and cylinder 15′ A pair of sealing rings 42*a*′, 42*b*′ carried in respective grooves 43*a*′, 43*b*′ surround cylinder 17′ and seal the cylinder with respect to wall 7′. A passage 115 is provided in cylinder block 9′ to provide communication between the crankcase chamber in the block which accommodates bearing 35*a*′, 35*b*′ and inlet ports 103. This passages allows pressure build-up in the crankcase chamber to be relieved.

In operation of this two-cycle engine 101, with its cylinder block 9′ rotating within housing 5′, pistons 17′ are caused to reciprocate within their respective cylinders 15′. Starting with a piston at its top dead center position adjacent a spark plug 31′, the spark plug is fired thereby to ignite a compressed air-fuel mixture in cylinder 15. This drives the piston toward sun gears 13*a*′, 13*b*′ during the power phase of its operational cycle and causes cylinder block 9′ and shaft 10′ to rotate in clockwise direction (as viewed in FIG. 6). As a cylinder 15′ rotates past an exhaust port 25′, the cylinder is opened for communication to the atmosphere and thus exhaust gases within the cylinder are discharged to the atmosphere via exhaust pipes 49′. This exhaust phase of the operational cycle of this two-cycle engine takes place as the piston moves toward its bottom dead center position. Prior to the piston moving to its bottom dead center position, the piston uncovers inlet openings 113 in the cylinder wall of cylinder block 9′ thereby to open communication between intake manifold 111 and cylinder 15′. Air then enters the cylinder via slots 105*a*, 105*b* in cover plates 12*a*′, 12*b*′ and inlet passages 109*a*, 109*b*. It will be noted that there is an overlap during which both the exhaust and the intake ports are simultaneously in communication with cylinder 15′. This insures that substantially all of the exhaust gases are discharged from the cylinder via exhaust port 25′ and also insures that a full charge of fresh air is inducted into the cylinder. As the piston moves from its bottom dead center to its top dead center position, the piston closes off manifold openings 113 and thus seals the cylinder with respect to housing 5. As the piston continues to move towards its top dead center position, the charge of air within the cylinder is compressed and as the piston nears its top dead center position, fuel injection nozzle 27′ injects a premeasured quantity of fuel into the cylinder and spark plug 31′ fires to ignite the air-fuel mixture and to begin another operational cycle of the engine. It will be noted that for a given rotational speed of output shaft 10′, the speed of piston 17′ with the two-cycle engines is only one-half of the piston speed with the four-cycle engine heretofore described.

Inlets 109*a*, 109*b* to manifold 107 act as scoops to, in effect, ram air into the manifold as cylinder block 9′ rotates. This ramming of air into the manifold causes the air to enter cylinders 15′ under pressure thereby to more completely purge exhaust gases from within the cylinders (there is some overlap where both the exhaust and inlet ports are open to the cylinders) and to force more air for combustion into the cylinders, resulting in greater power output than in conventional two-cycle engines.

It will be understood that two or more engines of this invention may be ganged together with their shafts 10 in line and coupled to one another.

It will also be understood that by suitably increasing the compression ratio of the engine and by providing a suitable fuel injection system, the engine of this invention may be modified to operate as a compression ignition (Diesel) engine.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Expansible chamber apparatus for use as an internal-combustion engine comprising a stationary housing having a cylindric chamber therein, a cylindric cylinder block rotatable within said chamber about a central axis, a shaft secured to and rotatable with said cylinder block, the longitudinal axis of said shaft constituting said central axis, said cylinder block having a plurality of cylinders therein extending inwardly from the outer cylindric surface of said cylinder block, each cylinder having a central cylinder axis, these cylinder axes being tangent to a common circle surrounding said central axis, a plurality of pistons, one for each cylinder, reciprocable within its respective cylinder, stationary gear means surrounding said shaft, means connecting each piston and said stationary gear for effecting rotation of the cylinder block and shaft about said central axis upon reciprocation of said pistons, said connecting means for each piston comprising a pinion gear in mesh with said stationary gear means and a connecting link pivotally secured to its respective piston and pivotally secured to its respective pinion gear offset from the center thereof so that upon reciprocation of said pistons said pinion gears are driven around said stationary gear means thereby to effect rotation of said cylinder block, and air intake means, fuel ignition means and exhaust means spaced at intervals around said housing for delivery of air and fuel for each cylinder, ignition of the resulting air-fuel mixture in each cylinder and exhaust of the products of combustion as the cylinder block rotates within said housing, each said pinion gear being so structured in relation to said ring gear that each piston moves through a power phase, an exhaust phase, an intake phase and a compression phase during each revolution of its respective pinion gear, said housing comprising a cylindric wall having said cylindric chamber therewithin, and a pair of covers, one for each end of said cylindric wall, for closing said cylindric chamber, and said air intake means comprising manifold means within said rotating cylinder block surrounding each said cylinder, a plurality of openings in said cover plates, passages in said rotating cylinder block providing communication between said openings and said manifold means, and a plurality of openings in said cylinder block providing communication between said manifold means and said cylinder, these last said openings being positioned intermediate the ends of the stroke undergone by said piston in said cylinder as it reciprocates to open and close communication between said cylinder and said manifold in timed relation to movement of said piston.

2. Expansible chamber appartus for use as an internal-combustion engine comprising a stationary housing having a cylindric chamber therein, a cylindric cylinder block rotatable within chamber about a central axis, a shaft secured to and rotatable with said cylinder block, the longitudinal axis of said shaft constituting said central axis, said cylinder block having a plurality of cylinders therein extending inwardly from the outer cylindric surface of said cylinder block, each cylinder having a central cylinder axis, these cylinder axes being tangent to a common circle surrounding said central axis, a plurality of pistons, one for each cylinder, reciprocable within its respective cylinder, stationary gear means surrounding said shaft, means connecting each piston and said stationary gear for effecting rotation of the cylinder block and shaft about said central axis upon reciprocation of said pistons, said connecting means for each piston comprising a pinion gear in mesh with said stationary gear means and a connecting link pivotally secured to its respective piston and pivotally secured to its respective pinion gear offset from the center thereof so that upon reciprocation of said pistons said pinion gears are driven around said stationary gear means thereby to effect rotation of said cylinder block, and air intake means, fuel ignition means and exhaust means spaced at intervals around said housing for delivery of air and fuel for each cylinder, ignition of the resulting air-fuel mixture in each cylinder and exhaust of the products of combustion as the cylinder block rotates within said housing, said housing comprising an outer cylindric wall constituting a cylindric wall for said chamber, and said cylinder block having means carried on its outer cylindric surface slidably engageable with said chamber wall for sealing each cylinder with respect to said housing, said cylindric housing wall having a series of openings therein spaced at intervals therearound constituting said air and fuel intake means, each of said openings comprising a series of side-by-side slots in said cylindric housing wall with the portions of said cylindric housing wall between said slots being engageable with said sealing means carried by said cylinder block with the slots of one of said series of slots being of various lengths so that as said cylinders rotate with said cylinder blocks all of said slots in said series of slots are simultaneously opened for communication with said cylinders and are simultaneously closed for blocking communication with said cylinders as each of said cylinders rotates therepast.

3. Apparatus as set forth in claim 1 wherein said central axes of said cylinders being tangent to said common circle establishes a radial offset of said pistons relative to said longitudinal axis of said shaft thereby to increase the torque output of apparatus.

4. Apparatus as set forth in claim 1 having an even number of cylinders with each cylinder having a corresponding cylinder substantially diametrically opposed thereto with the pistons of these opposed cylinders being in-phase with one another so as to undergo substantially simultaneous power phases thereby to apply a uniform and balanced force to opposite sides of said cylinder block.

5. Apparatus as set forth in claim 2 having an even number of cylinders with each cylinder having corresponding cylinder substantially diametrically opposed thereto with the pistons of these opposed cylinders being in-phase with one another so as to undergo substantially simultaneous power phases thereby to apply a uniform and balanced force to opposite sides of said cylinder block.

* * * * *